US010028561B2

(12) United States Patent
Vecellio

(10) Patent No.: US 10,028,561 B2
(45) Date of Patent: Jul. 24, 2018

(54) LUGGAGE CASE WITH INTERNAL RETAINING MEMBERS

(71) Applicant: Samsonite IP Holdings S.ar.l., Luxembourg (LU)

(72) Inventor: Corrado Vecellio, Padua (IT)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 419 days.

(21) Appl. No.: 14/330,730

(22) Filed: Jul. 14, 2014

(65) Prior Publication Data

US 2015/0014108 A1 Jan. 15, 2015

(30) Foreign Application Priority Data

Jul. 15, 2013 (EP) ..... 13176469
Jul. 9, 2014 (IN) ..... 1915/DEL/2014

(51) Int. Cl.
*A45C 13/02* (2006.01)
*A45C 5/03* (2006.01)
(Continued)

(52) U.S. Cl.
CPC ..... *A45C 13/02* (2013.01); *A45C 5/03* (2013.01); *A45C 5/14* (2013.01); *A45C 13/03* (2013.01)

(58) Field of Classification Search
CPC .. A45C 3/02; A45C 3/004; A45C 5/00; A45C 5/02; A45C 5/14
USPC ..... 190/100, 107, 109, 18 A; 206/289, 290, 206/292, 298, 527; 224/160, 572, 666, 224/667; 24/136 K, 195, 300–303, 613, 24/574.1
See application file for complete search history.

(56) References Cited

U.S. PATENT DOCUMENTS 1,954,607 A 4/1934 Wheary et al.
5,398,807 A * 3/1995 Plath ..... A45C 5/14 190/109
(Continued)

FOREIGN PATENT DOCUMENTS

CN 2251282 Y 4/1997
CN 2449546 Y 9/2001
(Continued)

OTHER PUBLICATIONS

Extended European Search Report for European Patent Application No. 14176694.9, 6 pages.

*Primary Examiner* — Fenn C Mathew
*Assistant Examiner* — Cynthia Collado
(74) *Attorney, Agent, or Firm* — Dorsey & Whitney LLP

(57) ABSTRACT

A luggage case may include a connector assembly including a first connector and a second connector that releasably connect together. The first connector may be attached to a first flexible retaining member at a position spaced from the attachment of the first flexible retaining member to a respective wall. The second connector may be attached to one of the walls in opposing relationship to the first connector. The first and/or second connectors and/or walls may be adapted to selectively attach the first and/or second connectors to respective walls so that the first connector and/or the second connector are more easily accessible during and after packing one's belongings in the case (than more conventional buckle components, and offer an improvement and alternative to conventional luggage articles.

22 Claims, 10 Drawing Sheets

(51) Int. Cl.
*A45C 13/03* (2006.01)
*A45C 5/14* (2006.01)

(56) References Cited

U.S. PATENT DOCUMENTS 5,459,910 A * 10/1995 Anscher ..... A42B 3/08 2/421
5,474,162 A * 12/1995 Shyr ..... A45C 5/14 190/109
5,620,215 A * 4/1997 Janeway ..... E05B 65/0888 292/256
5,809,620 A * 9/1998 Crowley ..... B60P 7/0838 24/265 CD
5,964,178 A 10/1999 Gonda
6,216,322 B1 4/2001 Kuo
6,325,189 B1 * 12/2001 King ..... A45C 3/001 190/119
6,347,693 B1 * 2/2002 Chen ..... A45C 7/0045 190/102
6,595,354 B1 7/2003 Scicluna
6,955,616 B1 * 10/2005 Barth ..... A63B 69/0002 473/217
7,228,962 B2 * 6/2007 Scicluna ..... A45C 7/0027 206/279
7,325,281 B1 * 2/2008 Willems ..... B60R 25/00 24/302
2008/0127461 A1 * 6/2008 Linden ..... A45F 5/02 24/302
2010/0294607 A1 * 11/2010 Morszeck ..... A45C 13/02 190/124

FOREIGN PATENT DOCUMENTS

CN 2473586 Y 1/2002
CN 201435950 U 4/2010
CN 202842620 U 4/2013
CN 204232439 U 4/2015
EP 0865997 A1 9/1998
EP 2275331 A1 * 1/2011 ..... B62J 7/08
WO 2012030214 A1 3/2012

* cited by examiner

LUGGAGE CASE WITH INTERNAL RETAINING MEMBERS

CROSS-REFERENCE TO RELATED APPLICATIONS

This application claims priority to European Patent Application No. 13176469.8, filed on Jul. 15, 2013 and entitled "A Luggage Case With Internal Retaining Members," and claims also priority to Indian Patent Application No. 1915/DEL/2014 filed on Jul. 9, 2014 and entitled "A Luggage Case With Internal Retaining Members", which are hereby incorporated in their entireties by reference as though fully disclosed herein.

TECHNICAL FIELD

The present disclosure relates to a luggage article, and in particular to luggage cases with internal retaining members which are releasably connected together within the case to retain items within the enclosed volume of the luggage case.

BACKGROUND

Luggage items and in particular luggage cases (i.e., suitcases) conventionally include opposing retaining members, such as straps (often called cross band straps) and/or divider panels, that are attached to an inner surface of the case, extend across the enclosed storage volume of the case, and are releasably connected together by corresponding connectors. After packing a case with one's belongings, the retaining members generally are positioned over the belongings and the connectors are connected together to hold the belongings in place during transport. The connectors are detachable from one another to allow separation of the connectors and retaining members and removal of the belongings from the case. An example of such configuration is shown in U.S. Pat. No. 6,595,354.

A problem that has been identified with conventional cases is that the connectors and/or retaining members generally are positioned at the bottom of the case during packing. As such, the connectors and/or retaining members are commonly buried underneath one's belongings during packing. Locating the connectors and/or retaining members beneath the belongings may be difficult and/or time consuming, and may disturb the arrangement of the belongings.

It is therefore desirable to provide an improved luggage article, and more specifically an improved content retention system that addresses the above described problems and/or which more generally offers improvements or an alternative to existing arrangements.

Documents that may be related to the present disclosure in that they include various connectors are: CN 2473586, EP 2275331, WO 2012/030214, U.S. Pat. Nos. 5,964,178, 6,216,322, and 6,595,354.

SUMMARY

According to the present disclosure there is therefore provided a luggage article as described in the accompanying claims.

In an embodiment of the invention, a luggage article may include a plurality of walls together defining an outer structure and enclosed space of the luggage article, a first flexible retaining member attached to and extending from one of the walls across the enclosed space, and a connector assembly. The connector assembly may include a first connector and a second connector that releasably connect together. The first connector may be attached to the first flexible retaining member at a position spaced from the attachment of the first flexible retaining member to the respective wall. The second connector may be attached to one of the walls in opposing relationship to the first connector. When the first and second connectors are releasably connected together, the first retaining member may be extended across at least a portion of the enclosed space. The luggage article may be characterized in that the first and second connectors and/or walls may be adapted to selectively attach the respective first and second connectors to one of the walls.

The first and second connectors and/or walls may include a clip or hook. The connector assembly and/or walls may include a clip or hook. The clip or hook may be positioned at a distal end of the first flexible retaining member. The clip or hook may be formed as an integral part of the first and second connectors. The clip or hook may be attached to the first flexible retaining member. The first and second connectors may be directly attached to the respective wall. The first and second connectors may be indirectly attached to the respective wall. The clip or hook may include two resilient fingers having laterally-offset free ends. The clip or hook may be adapted to fit over a peripheral edge of the wall of the luggage article when the luggage article is open. The first and second connectors may include corresponding connector engagement features that releasably connect the first and second connectors together. The first and second connectors may releasably snap fit together axially along and/or rotationally about a longitudinal axis of the connectors. The first retaining member may be attached to the first connector between a respective connector engagement feature and the clip or hook. The first retaining member may be a strap. The strap may be attached at opposite ends to a respective wall. The first connector may be attached to a mid-portion of the strap. The first retaining member may be a flexible panel. The first and second connectors and/or walls may include an attachment element or feature that cooperates with the clip or hook to attach the first or second connectors to the wall. The connector assembly may include a push button release mechanism to release the first and second connectors. The connector assembly may be a buckle assembly. The first and second connectors may comprise first and second buckle components.

The luggage article may include a second flexible retaining member attached to and extending from one of the walls. The second connector may be attached to the second retaining member at a position spaced from the attachment of the second retaining member to the respective wall. The luggage article may include an opening line formed in the walls along which the luggage article separates into a lid section and a base section to allow access to the enclosed space within the luggage article.

The present disclosure advantageously provides a luggage article with an internal content retention system that attaches to a side or end wall of the luggage article. The internal content retention system may include corresponding connectors that mate together to secure at least one internal retaining member across an enclosed space of the luggage article, thereby retaining the contents of the case. The connectors may be releasably and temporarily secured to and located on any side or end wall of the case when in a stowed position. By securing the internal content retention connectors to a side or end wall of the case, the connectors and associated retaining members may be easily accessible by a user during and after packing one's belongings in the case, which is advantageous compared to conventional luggage articles in which the connectors and/or retaining members frequently are buried underneath one's belongings during packing.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present disclosure will now be described by way of example only with reference to the following figures in which.

DETAILED DESCRIPTION

Figure 1:
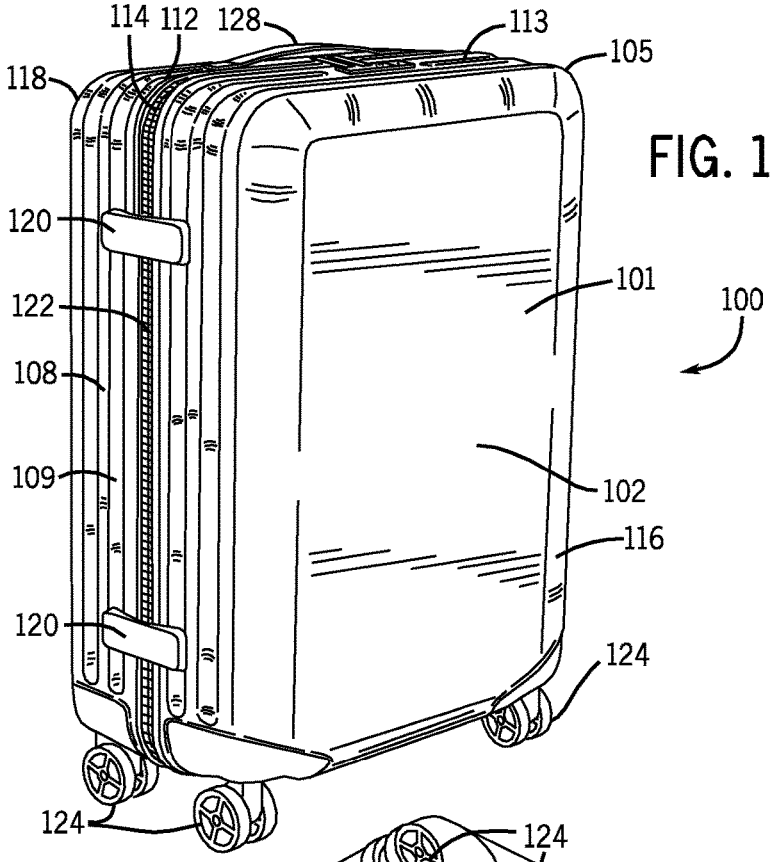
FIG. 1 is a schematic front perspective view of a luggage case according to an embodiment of the invention.
Figure 2:
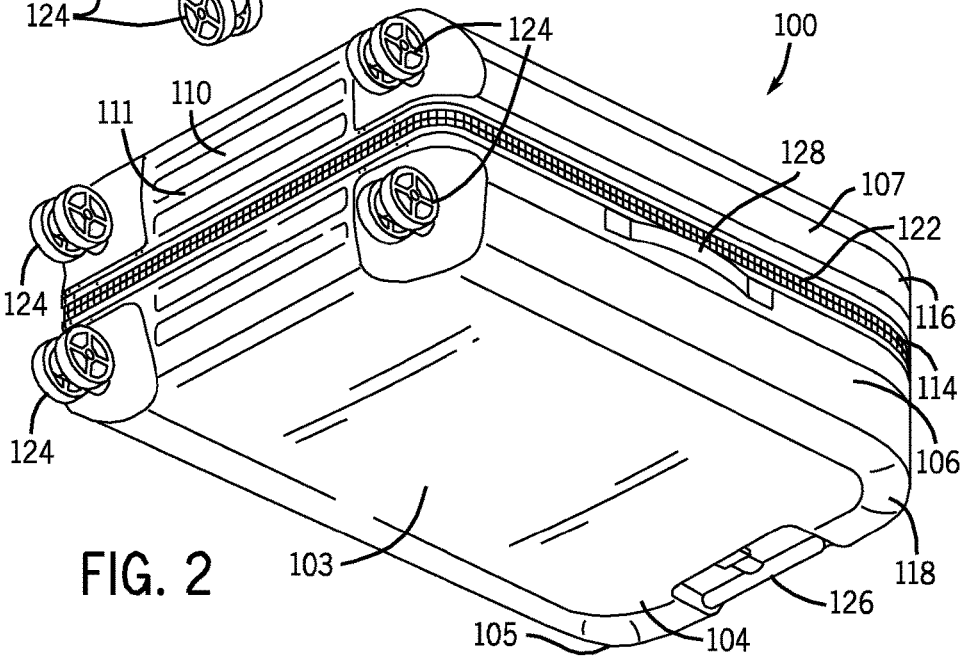
FIG. 2 is a schematic rear view of a luggage case shown in FIG. 1.

Referring to FIGS. 1-3B, a wheeled luggage case 100 according to an example of the invention includes a generally cuboid structure 105 formed from a plurality of walls 102,104,106,108,110,112 defining an enclosed internal volume 115 of the luggage case 100 in which to carry a user's belongings. The luggage case 100 includes opposing front and rear walls 102,104 forming major front and rear faces 101,103 of the luggage case 100, opposing side walls 106,108 forming side faces 107,109 of the case 100, and opposing top and bottom end walls 110,112 of the case 100 that together all define a housing or an outer structure 105 of the case 100 that, in turn, defines an enclosed internal volume 115. The major front and rear faces 101,103 have a height and a width of the case 100. The side faces 107,109 have a similar height and a depth of the case 100. The top and bottom ends 110,112 of the case 100 extend across the width and depth of the case 100. The height of the major faces 101,103, and so of the case 100, is greater than the width of the case 100, which is greater than the depth of the case sides 106,108 and the case 100. The case 100 may be hard and/or soft sided.

The case 100 is split along a generally vertical plane and opening line 114 parallel to the major faces 101,103 into a lid section 116, which includes the front wall 102, and a base section 118, which includes the rear wall 104. In this example, the opening line 114 is located parallel to the front and rear faces 103 such that the base section 118 comprises the rear wall 104 and a portion of the side and end walls 106,108,110,112, and the lid section 116 comprises the front wall 102 and a remaining portion of the side and end walls 106, 108, 110, 112. In some embodiments, the opening line 114 may be centrally located mid-way between the front and rear faces 101, 103 such that the lid and base sections are more similarly sized. In other embodiments, the opening line 114 may be located closer to or on the front face 101 such that the base section 118 comprises a majority of the side and end walls 106, 108, 110, 112, and the lid section 116 comprises a minority of the side and end walls 106, 108, 110, 112, or vice versa.

The lid section 116 is connected to the base section 118 along a side via a hinge 120 in a conventional manner, and the case 100 is opened at the opening line 114 to access the internal volume 115. The hinge 120 may be formed of a zipper 122 and a fabric strip, a piano hinge, discrete hinges spaced apart, or an articulating joint. The piano hinge, the discrete hinges, or the articulating joint may be made from metal, plastic, any other suitable material, or any combination thereof. The hinge 120 may be stitched to the lid 116 and also to the base 118, or may be coupled in another suitable manner. In some examples, the luggage case 100 may be hinged along the left or the right side wall 106, 108, whereas in other examples, the luggage case 100 may be hinged along the bottom 110, or along any other face of the luggage case 100. A zipper 122 along a periphery of the opening line 114 or other conventional closure arrangement, for example clamp locks, secures the lid section 116 to the base section 118 to close the case 100.

The case 100 may include at least one wheel assembly 124. The depicted case 100 includes four wheel assemblies 124 mounted from the bottom end wall 110 of the case 100 and located proximate the bottom end corners of the case 100, although the case 100 may include other wheel arrangements. The wheel assemblies 124 may be rotatable or fixed about a vertical axis.

Figure 3A:
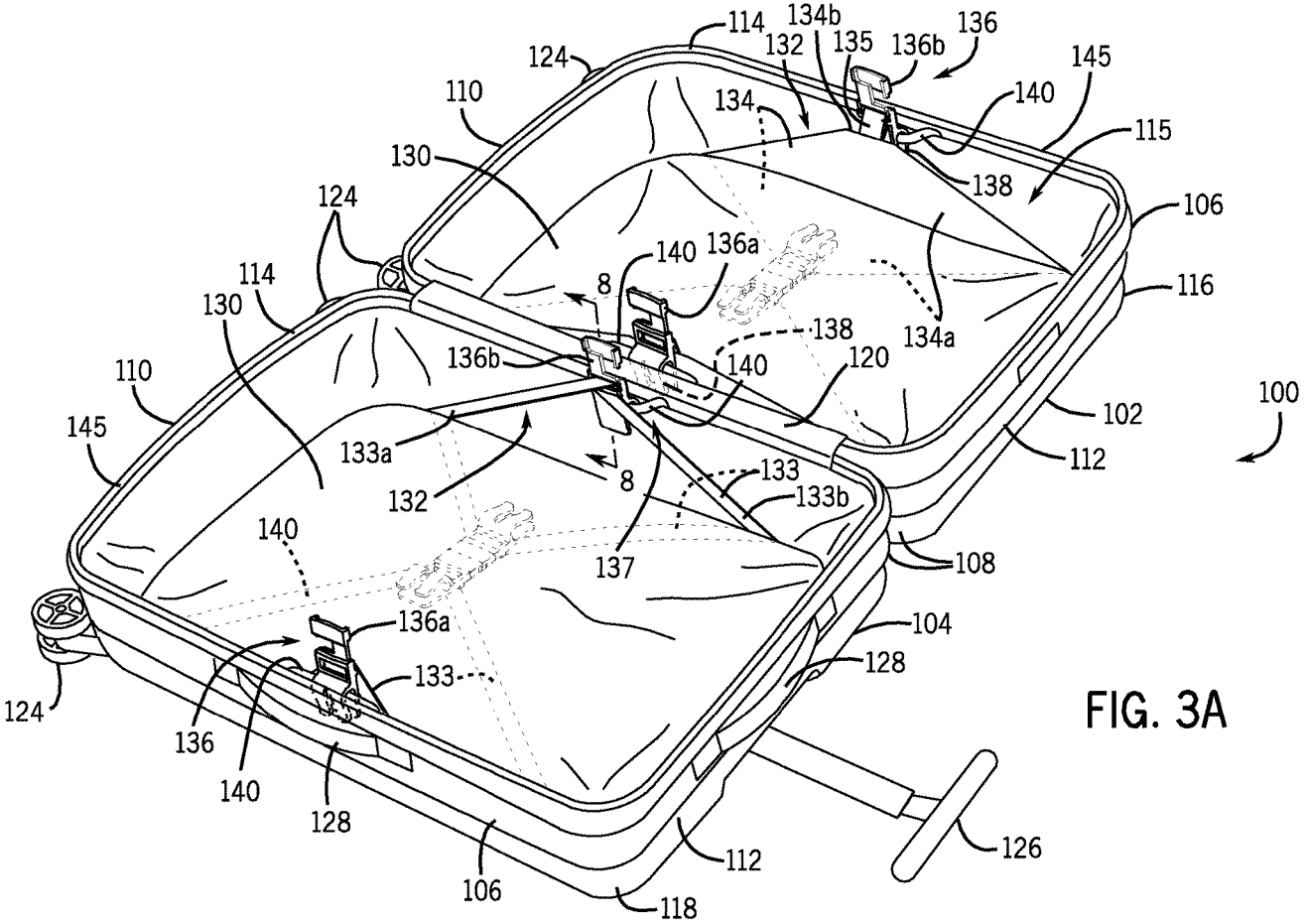
FIG. 3A is a schematic front perspective view of a luggage case shown in FIG. 1 in an open position with example internal retaining members attached to opposing side walls.
Figure 3B:
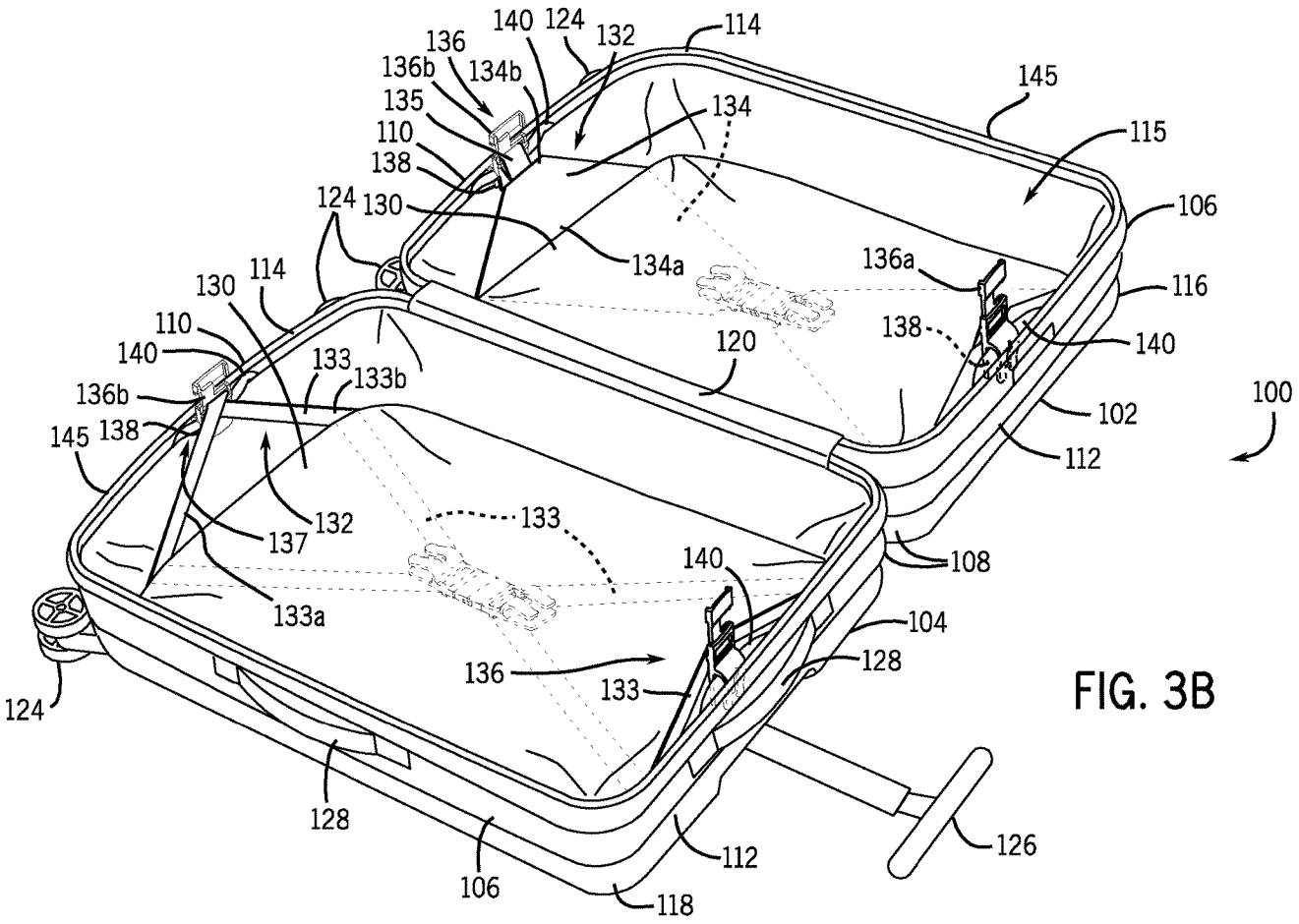
FIG. 3B is a schematic front perspective view of a luggage case shown in FIG. 1 in an open position with example internal retaining members attached to opposing end walls.

The case 100 may include at least one handle. The depicted case 100 includes a telescoping tow handle 126 associated with the top wall 112. The depicted case also includes fixed carry handles 128 attached to the top wall 112 and the side wall 106. The telescoping handle 126 and the fixed carry handles 128 may be associated with any wall 106,108,110,112 of the case 100. FIGS. 3A and 3B show the luggage case 100 in an open position with the lid section 116 pivoted about the hinge 120 relative to the base section 118 such that the internal volume 115 of the case 100 is visible. In the open position, the front and rear walls 102,104 of the case 100 may be coplanar, and portions of the side wall 108 associated with the lid and base sections 116,118 may confront one another. A hinge 120 may connect the confronting portions of the side wall 108. Also, a liner 130 may be attached to an inner surface of the lid and base sections 116,118.

The case 100 may include opposing flexible retaining members 132, such as straps 133 and/or panels 134, associated with the lid section 116, the base section 118, or both as shown in FIGS. 3A and 3B. The retaining members 132 may be attached to and extend from opposing walls 106, 108,110,112 or opposing portions of a wall 102,104 of the case 100. As shown in FIGS. 3A and 3B, the case 100 includes straps 133 associated with the base section 118 and panels 134 associated with the lid section 116. The straps 133 are attached at opposite ends 133*a*, 133*b* to the base section 118 of the case 100, and the panels 134 are attached at only one end 134*a* to the lid section 116 of the case 100. Each strap 133 and panel 134 has an effective length that extends only partially across the enclosed space 115 of the case 100 from one wall to an opposing wall such that when connected together the respective straps 133 and panels 134 extend across the entire enclosed space 115 between the respective opposing walls. In other configurations, the straps 133 and/or panels 134 may be associated with the lid section 116 and/or the base section 118 of the case 100. The straps 133 may be attached at only one end 133*a* or 133*b* to the case 100 such that each strap 133 includes a free end that may be attached to a connector, as discussed below. The strap 133, the panel 134, or both may be adapted to extend across the entire enclosed space 115 of the case 100 from one wall to an opposing wall. In these configurations, only one strap 133 or panel 134 may be needed for each section 116,118 of the case 100, and a free end of the strap 133 or panel 134 may be directly attached to the opposing wall via cooperating connectors. The strap 133 may be referred to as a cross band or ribbon, and the panel 134 may be referred to as a gusset.

The case 100 may include a connector assembly 136 associated with the lid section 116, the base section 118, or both as shown in FIGS. 3A and 3B. Each connector assembly 136 may comprise two connectable components: a first connector 136*a* and a second connector 136*b*. The first and second connectors 136*a*,136*b* each may be attached to the case 100 by a separate retaining member 132 at a position spaced from the attachment of the retaining member 132 to a respective wall 102,104,106,108,110,112 such that the first and second connectors 136*a*,136*b* generally oppose one another.

As shown in FIG. 3, the first and second connectors 136*a*, 136*b* may be adjustably attached to a respective strap 133 such that the connectors 136*a*, 136*b* are movable along a length of the respective strap 133 between the first and second ends 133*a*, 133*b* of strap 133, which may be secured to the case 100 at spaced apart locations along an intersection of the rear wall 104 and a respective side wall 106,108. As shown in FIG. 3, the connectors 136*a*, 136*b* may be positioned mid-way along the length of the respective strap 133. In some embodiments, the straps 133 may include only one end that is attached to the case 100, and the connectors 136*a*, 136*b* may be adjustably associated with the other end of the respective strap 133. The straps 133 may be elastic, non-elastic, or both. In cases 100 including a panel 134, the connectors 136*a*, and 136*b* may be attached to the panel 134, such as with a loop of flexible material 135 sewn or otherwise attached to a free end 134*b* of the panel 134.

When the first and second connectors 136*a*, 136*b* are releasably connected together, the retaining members 132 are extended over one's belongings across the enclosed space 115 of the case 100 to secure the belongings in the respective lid or base section 116,118. In this connected configuration, the location of the connector assembly 136 relative to the walls 106,108,110,112 of the case 100 may vary based on the amount of belongings packed in the respective lid or base section 116,118, the shape of the belongings, and any other factor. The connector assembly 136 and associated retaining member 132 may be referred to as a content securing member.

With continued reference to FIGS. 3A and 3B, the respective first and second connectors 136*a*,136*b* are disconnected from one another and releasably secured to opposing walls 106,108,110,112 of the luggage case 100 to positively locate the buckle components 136*a*,136*b* and associated retaining members 132 near a periphery of the front and rear walls 102,104 of the respective lid and base sections 116,118 of the case 100, thereby allowing the user to easily find the connectors 136*a*,136*b* during and after packing. In FIG. 3A connectors 136*a*, 136*b* are attached to opposing side walls 106,108 of the case 100, whereas in FIG. 3B the connectors 136*a*, 136*b* are attached to the end walls 110,112 of the case 100.

The connectors 136*a*, 136*b* may be secured to the walls 106,108,110,112 of the case 100 at various positions along the depth of the respective walls 106,108,110,112. To reduce the inconvenience of the connectors 136*a*, 136*b* and retaining members 132 being buried underneath one's belongings during packing, the connectors 136*a*, 136*b* may be removably secured to the walls 106,108,110,112 near the opening line 114 of the case 100, thereby keeping the connectors 136*a*, 136*b* spaced away from the front and rear walls 102,104 of the respective lid and base sections 116,118 of the case 100. In one example, the connectors 136*a*,136*b* are secured to the walls 106,108,110,112 along a peripheral edge or rim 145 of the lid and base sections 116,118 such that the connectors 136*a*,136*b* and/or associated retaining members 132 are easily accessible by a user during and after packing one's belongings in the case 100.

The first and second connectors 136*a*, 136*b* and/or walls 106,108,110,112 may be adapted to selectively attach or engage the respective first and second connectors 136*a*, 136*b* to one of the walls 106,108,110,112 of the respective lid or base section 116,118 of the luggage case 100. The first and second connectors 136*a*, 136*b* and/or walls 106,108, 110,112 may include a clip or hook 138, and the other of the first and second connectors 136*a*, 136*b* and/or walls 106, 108,110,112 may include a corresponding engagement feature, such as a loop of cord 140 or other material or a defined recess, that cooperates with the clip or hook 138 to attach the first and second connectors 136*a*, 136*b* to the respective walls 106,108,110,112. In other configurations, the first and second connectors 136*a*, 136*b* and/or the walls 106,108,110, 112 may be detachably connected to one another with corresponding parts of a hook and loop fastener, a snap fastener, a magnetic fastener, or other suitable separable fasteners that permit connection and disconnection of the connectors 136*a*, 136*b* to and from one another and/or the respective walls 106,108,110,112. In one implementation, one part of a separable fastener may be attached to a connector 136*a*, 136*b* and the other part of the separable fastener may be attached to a wall 106,108,110,112.

Figure 4:
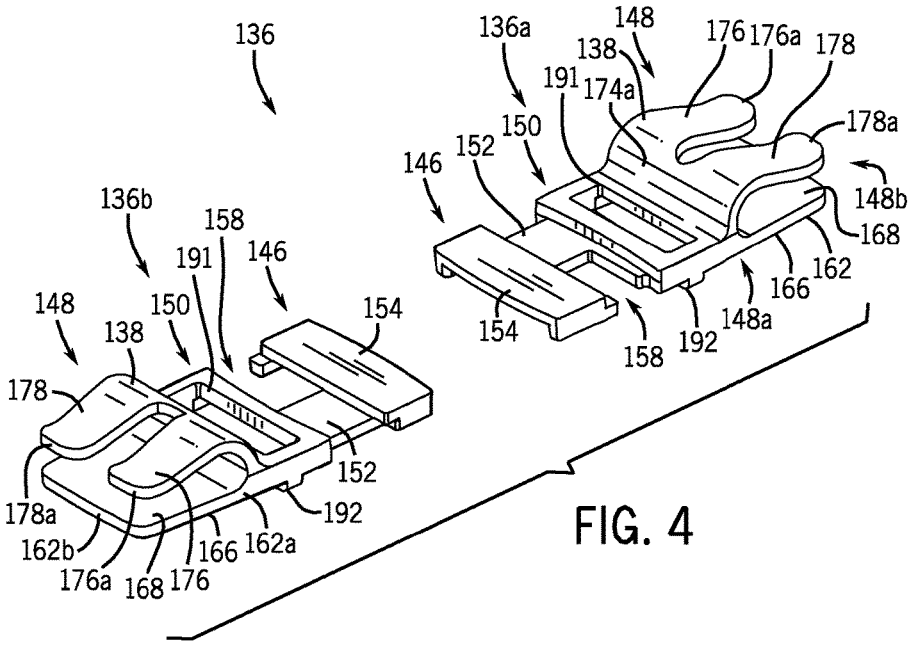
FIG. 4 is a schematic front perspective view of a buckle of a luggage case shown in FIG. 1.
Figure 5:
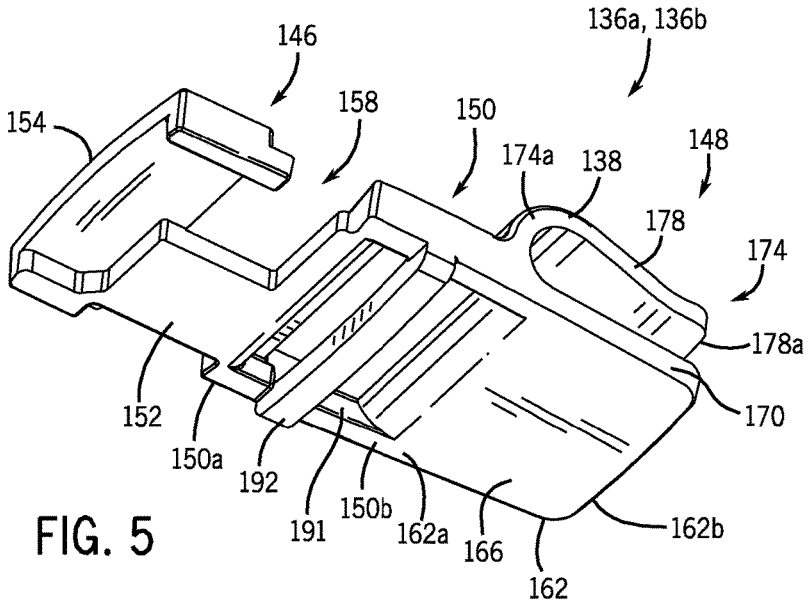
FIG. 5 is a schematic rear perspective view of a buckle component shown in FIG. 4 of a luggage case shown in FIG. 1.

FIGS. 4-7 are schematic views of the first and second connectors 136*a*, 136*b* according to an embodiment of the invention. As shown in FIG. 4, the first and second connectors 136*a*, 136*b* are mirror images of one another. Thus, in FIG. 4, the common features of the connectors 136*a*, 136*b* are identified with the same reference numerals, and in FIGS. 5-7 only one connector 136*a*, 136*b* is depicted.

As shown in FIGS. 4-7, the first and second connectors 136*a*,136*b* each include a connector engagement feature or portion 146, a wall engagement feature or portion 148, and a retaining member engagement feature or portion 150. The connector and wall engagement features 146, 148 define opposing ends of each connector 136*a*, 136*b*. The retaining member engagement feature 150 is located between the connector and wall engagement features 146, 148.

The connector engagement features 146 of the first and second connectors 136*a*, 136*b* are configured to matingly engage one another to secure the connectors 136*a*, 136*b* together. Each connector engagement feature 146 may include a bridge 152 connected to one end 150*a* of the retaining member engagement feature 150 and a latch plate 154 connected to one end of the bridge 152. The latch plates 154 of opposing connectors 136*a*,136*b* may nest together within axial gaps 158 defined between the latch plate 154 and one end 150*a* of the retaining member engagement feature 150.

The wall engagement feature 148 of the connectors 136*a*, 136*b* is configured to attach the connectors 136*a*, 136*b* to a wall 106,108,110,112 of case 100. The wall engagement feature 148 may be integrally connected to and extend longitudinally away from an opposing end 150*b* of the retaining member engagement feature 150 relative to the connector engagement feature 146. The wall engagement feature 148 may include the clip or hook 138 spatially separated from a base plate 162 to define a receiving space 163 between the clip or hook 138 and the plate 162. Alternatively, in configurations where the clip or hook 138 is associated with a wall 106,108,110,112 of the case 100, the wall engagement feature 148 of the connectors 136*a*, 136*b* may include a loop of material, such as a cord, or other suitable feature that cooperates with the clip or hook positioned on the wall.

Figure 6:
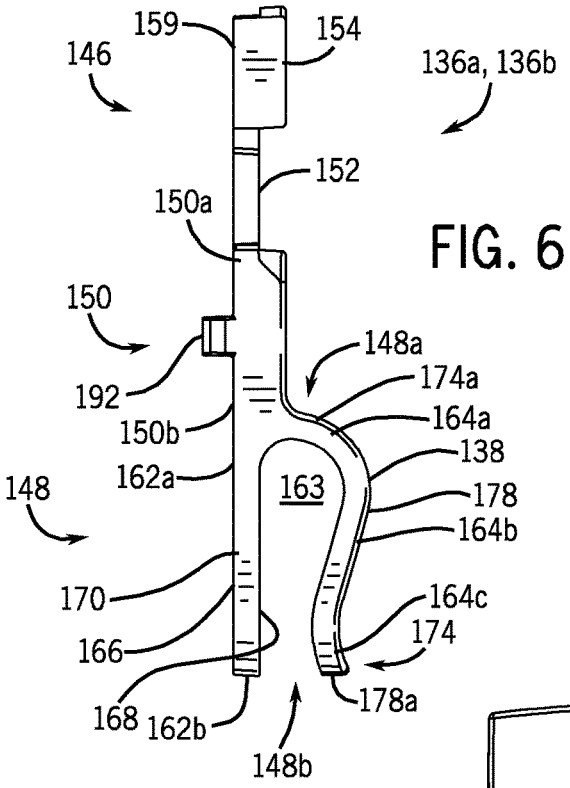
FIG. 6 is a schematic elevation view of a buckle component shown in FIG. 4 of a luggage case shown in FIG. 1.

The base plate 162 of the wall engagement feature 148 may have a planar profile. The base plate 162 may include a first end 162*a* that is integrally connected to one end 150*b* of the retaining member engagement feature 150 and a second, free end 162*b*. The base plate 162 may include an outer surface 166 and an inner surface 168, which may be parallel to one another. The outer surface 166 of the plate 162 may be coplanar with a rear surface of the connector engagement feature 146, the retaining member engagement feature 150, or both as shown in FIG. 6. The inner surface 168 of the plate 162 may be positioned vertically between the outer surface 166 of the base plate 162 and a front surface of the connector engagement feature 146, the retaining member engagement feature 150, or both as shown in FIG. 6. The base plate 162 may include opposing side surfaces 170,172 that taper inwardly toward one another as the surfaces 170,172 extend from the first end 162*a* to the second end 162*b* of the plate 162 (see FIG. 7).

Figure 7:
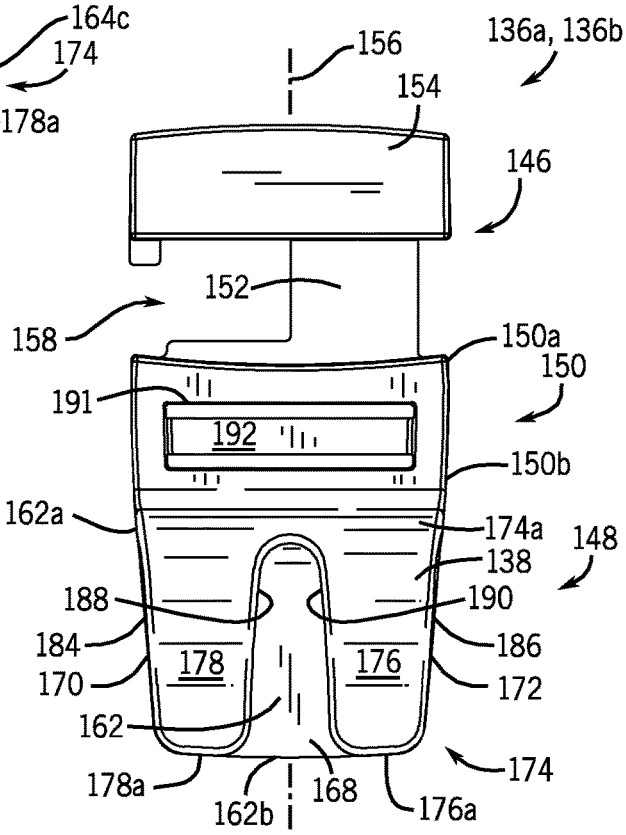
FIG. 7 is a schematic plan view of a buckle component shown in FIG. 4 of a luggage case shown in FIG. 1.

The clip or hook 138 of the wall engagement feature 148 may be formed as an integral part of the first and second connectors 136*a*, 136*b*. The clip of hook 138 may have an arcuate or curved profile. The clip or hook 138 may include one or more resilient fingers 174 integrally connected to one end 150*b* of the retaining member engagement feature 150. As shown in FIGS. 4-7, the clip or hook 138 may include two resilient fingers 176,178. As shown in FIGS. 6-7, the fingers 176,178 may be symmetrical about the longitudinal axis 156 of the connectors 136*a*, 136*b*. As shown in FIG. 7, the fingers 176,178 may include outer side surfaces 184,186 that are aligned with the side surfaces 170,172 of the base plate 162. The fingers 176,178 also may include opposing inner side surfaces 188,190 that are laterally separated from one another. The clip or hook 138 may include a common first end 174*a* that is integrally connected to one end 150*b* of the retaining member engagement feature 150 and laterally-offset free ends 176*a*,178*a* that define terminal ends of the fingers 176,178. As shown in FIG. 7, the free ends 176*a*, 178*a* of the fingers 176,178 may be aligned with the free end 162*b* of the base plate 162.

With reference to FIG. 6, the hook 164 may include a first downwardly-sloped segment 164*a* that is integrally formed with a lower end 150*b* of the retaining member engagement feature 150 and extends outwardly away from the inner surface 168 of the base plate 162, a second downwardly-sloped segment 164*b* that is integrally formed with a lower end of the first downwardly-sloped segment 164*a* and extends inwardly toward the inner surface 168 of the base plate 162, and a third downwardly-sloped segment 164*c* that is integrally formed with a lower end of the second downwardly-sloped segment 164*b* and flares outwardly away from the inner surface 168 of the base plate 162. The first downwardly-sloped segment 164*a* may have an arcuate or curved profile and define a convex outer surface and a concave inner surface. The second downwardly-sloped segment 164*b* may extend from the first downwardly-sloped segment 164*a* to the third downwardly-sloped segment 164*c* in a straight or substantially straight line that converges toward the base plate 162. The third downwardly-sloped segment 164*c* may have an arcuate or curved profile and define a concave outer surface and a convex inner surface. The third downwardly-sloped segment 164*c* may terminate at the free end of the clip or hook 138, which may be defined by the free ends 176*a*, 178*a* of the fingers 176,178. The transition between the second and third downwardly-sloped segments 164*b*, 164*c* may define, in conjunction with the base plate 162, a constricted neck region of the wall engagement feature 148, and the terminal end of the third downwardly-sloped segment 164*c* may define, in conjunction with the base plate 162, an entrance or mouth of the wall engagement feature 148.

Referring to FIGS. 4-7, the retaining member engagement feature 150 of the connectors 136*a*, 136*b* may be positioned axially between the connector engagement feature 146 and the wall engagement feature 148. The retaining member engagement feature 150 may be configured to attach the connectors 136*a*, 136*b* to the retaining member 132, such as the strap 133 (see FIGS. 3A and 8). The retaining member engagement feature 150 may define a peripherally-bounded aperture 191 and include a transversely-extending rail 192 spanning from one lateral side of the aperture 191 to an opposing lateral side of the aperture 191. To connect the connectors 136*a*,136*b* to the strap 133, a leading end of the strap 133 is routed into the aperture 191 adjacent one transversely-extending face of the rail 192, over the rail 192, and out of the aperture 191 adjacent an opposing transversely-extending face of the rail 192. In this way, the strap 133 is at least partially wrapped around the rail 192 to secure the connectors 136*a*, 136*b* to the straps 133. Similarly, in configurations having a gusset or panel 134, a loop of material 135 may be wrapped around the rail 192 to secure the connectors 136*a*, 136*b* to the panels 134.

Figure 8:
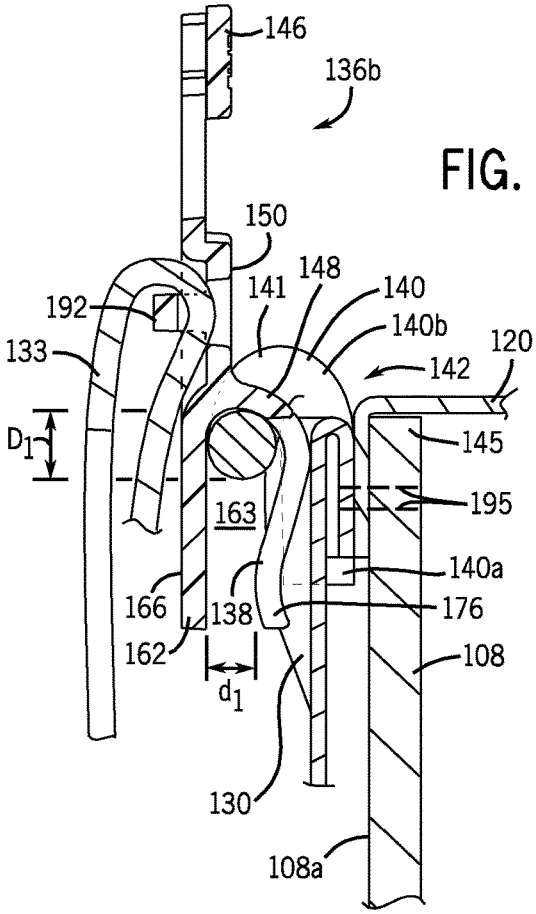
FIG. 8 is a schematic illustration of a buckle component shown in FIG. 4 of a luggage case shown in FIG. 1 with the buckle attached to a side wall of the luggage case.

FIG. 8 is a schematic illustration of an example attachment of the connectors 136*a*, 136*b* to the walls 106,108, 110,112 of the luggage case 100. As shown in FIG. 8, the second connector 136*b* is attached to the side wall 108 of the case 100. The first connector 136*a* may be attached to the opposing side wall 106 of the case 100 in a similar fashion (see FIGS. 3A and 3B). With specific reference to FIG. 8, the connector 136*b* is attached to a mid-portion of the cord 140, which may be sewn, adhered, or otherwise attached to the side wall 108. In FIG. 8, the ends (only one end 140*a* is in view) of the cord 140 are positioned between the liner 130 and the side wall 108 and attached to the side wall 108 with stitching 195. A hinge element 120, which may be fabric, may be positioned between the cord 140 and the side wall 108. An intermediate or middle portion 140*b* of the cord 140 may protrude from the seam 142 between the inner liner 130 and the hinge element 120 and form a loop 141 for engagement by the wall engagement feature 148 of the connector 136*b*. As such, the ends 140*a* of the cords 140 may be concealed by the liner 130, and a middle portion 140*b* of the cords 140 may be exposed for hanging the connectors 136*a*, 136*b* alongside the peripheral rim 145 of the walls 106,108, 110,112 of the case 100. This cord arrangement may be useful, for example, in circumstances in which the peripheral edge or rim 145 of the side wall 108 is covered or concealed by a hinge element 120 as shown in FIG. 8. In other configurations, the clip or hook 138 may be attached to the respective wall 106,108,110,112 and the cord 140 or other suitable feature may be attached to the connectors 136*a*, 136*b* so that the cord 140 or other suitable feature may cooperate with the clip or hook 138 to attach the first and second connectors 136*a*, 136*b* to opposing walls 106,108, 110,112 of the case 100.

In FIG. 8, the wall engagement feature 148 has been resiliently snapped onto the cord 140 such that the cord 140 is positioned within the inner space 163 of the wall engagement feature 148 of the connector 136*b*. The cord 140 has a larger diameter D1 than the constricted neck opening distance dl of the wall engagement feature 148, and thus the cord 140 is retained within the inner space 163 of the wall engagement feature 148. To remove the connector 136*b* from the side wall 108, the connector 136*b* may be pulled upwardly and/or inwardly relative to the side wall 108. As the connector 136*b* is pulled upwardly and/or inwardly, the cord 140 moves within the inner space 163 of the wall engagement feature 148 towards the entrance of the wall engagement feature 148. As the cord 140 passes through the constricted neck of the wall engagement feature 148, the cord 140 may be compressed inwardly, the clip or hook 138 and/or the base plate 162 may be expanded outwardly, or a combination thereof to permit removal of the cord 140 from the wall engagement feature 148 of the connector 136*b*. In other configurations, the clip or hook 138 may be positioned within a slot or opening defined in the seam 142. The slot or opening may be bounded and/or reinforced by stitching. In these configurations, the cord 140 may be omitted.

With reference to FIGS. 3A, 3B, and 8, when supported by the cord 140, the connectors 136*a*, 136*b* may be positioned in an upright orientation such that the wall engagement feature 148 is beneath the connector and retainer member engagement features 146, 150. In this upright orientation, the wall engagement feature 148 may be directed downwardly towards a confronting front or rear wall 102,104, and the connector engagement feature 146 may be directed upwardly away from the respective front or rear wall 102,104 (see FIGS. 3A and 3B). The wall engagement feature 148 may be positioned at least partially within the enclosed space 115 of the respective section 116,118 of the case 100 inwardly of the peripheral rim 145 of the associated wall 106,108,110,112 of the case 100. The connector and/or retaining member engagement features 146, 150 may extend above the peripheral rim 145 to provide easy accessibility to a user during and/or after packing one's belongings in the case 100. When in this stowed position, the connectors 136*a*,136*b* generally are positioned near a periphery of the respective sections 116,118 of the luggage case 100 and may permit closing of the case 100 without interfering with the closure path of the lid and base sections 116,118. In other words, in this arrangement, the connectors 136*a*,136*b* may not interfere with the hinge 120 or closing of the case 100, and the case 100 may be closed with the connectors 136*a*,136*b* located and stowed adjacent the walls 106,108,110,112 ready for use. The cord 140 and connectors 136*a*, 136*b* also may be modified and configured such that when stowed and located adjacent the walls 106,108,110, 112, the connectors 136*a*, 136*b* do not project beyond or above the peripheral edge 145 of the walls 106,108,110,112 to further reduce any interference and allow the case 100 to be closed with the connectors 136*a*, 136*b* and retaining members 132 stowed adjacent the walls 106,108,110,112.

Still referring to FIGS. 3A, 3B, and 8, the connectors 136*a*, 136*b* may be positioned adjacent an inner surface of the walls 106,108,110,112 of the case 100 when in the stowed position. As shown in FIG. 8, the connector 136*b* is positioned adjacent the inner surface 108*a* of the side wall 108. The clip or hook 138 may confront the inner surface 108*a* of the side wall 108, and the outer surface 166 of the base plate 162 may face away from the inner surface 108*a*. When associated with a luggage case 100 having an inner liner 130, the liner 130 may be positioned between the clip or hook 138 and the side wall 108 as shown in FIG. 8. In the depicted orientation, the rail 192 of the retaining member engagement feature 150 faces away from the inner surface 108*a* of the side wall 108 such that wall engagement feature 148 is positioned laterally between the strap 133 and the side wall 108. This configuration inhibits the strap 133 from interfering with or blocking the entrance of the wall engagement feature 148 since the strap 133 is positioned adjacent the outer surface 166 of the base plate 162 and may be in a tensioned or taut state when the wall engagement feature 148 is being attached to the side wall 108. Further, upon detachment of the connector 136*b* from the side wall 108 and then subsequent attachment of the connector 136*b* to a corresponding connector 136*a* associated with an opposing side wall 106 of the case 100, the connector 136*b* may be rotated about a pitch axis such that the connector engagement feature 146 substantially aligns with the connector engagement feature 146 of the corresponding connector 136*a*. Little to no rotation of the connector 136*b* about a roll axis may be needed after detachment of the wall engagement feature 148 from the wall 108, resulting in little to no twisting of the straps 133 as the connectors 136*a*, 136*b* are moved from the stowed position to the connected position (depicted in dashed lines in FIGS. 3A and 3B) in which the straps 133 are extended across the enclosed space 115 of the case 100 to retain one's belongings in the respective section 116,118 of the case 100.

The cord 140 may be sewn, adhered, or otherwise attached to the side wall 108. In FIG. 8, the ends (only one end 140*a* is in view) of the cord 140 are positioned between the liner 144 and the side wall 108 and attached to the side wall 108 with stitching 195. A hinge element 120, which may be fabric, may be positioned between the cord 140 and the side wall 108. An intermediate portion 140*b* of the cord 140 may protrude from the seam 142 between the inner liner 144 and the hinge element 120 and form a loop 141 for engagement by the clip feature 148 of the buckle component 136*a*. As such, the ends 140*a* of the cords 140 may be concealed by the liner 144 and a middle portion 140*b* of the cords 140 may be exposed for hanging the buckle components 136*a*, 136*b* along the peripheral rim 145 of the side walls 106,108. This cord arrangement may be useful, for example, in circumstances in which the peripheral edge or rim 145 of the side wall 108 is covered or concealed by a hinge element 120 as shown in FIG. 8.

As shown in FIG. 8, the cord 140 is positioned within the inner space 184 of the clip portion 148 of the buckle component 136*b*. The cord 140 has a larger diameter D1 than the constricted neck opening distance d1 of the clip feature 148, and thus the cord 140 is retained within the inner space 184 of the clip feature 148. To remove the buckle component 136*b* from the side wall 108, the buckle component 136*b* may be pulled upwardly and/or inwardly relative to the side wall 108. As the cord 140 moves within the inner space 184 of the clip feature 148 towards the entrance of the clip feature 148, the cord 140 may be compressed inwardly, the clip feature 148 may be expanded outwardly, or both to permit removal of the cord 140 from the clip feature 148.

Figure 9:
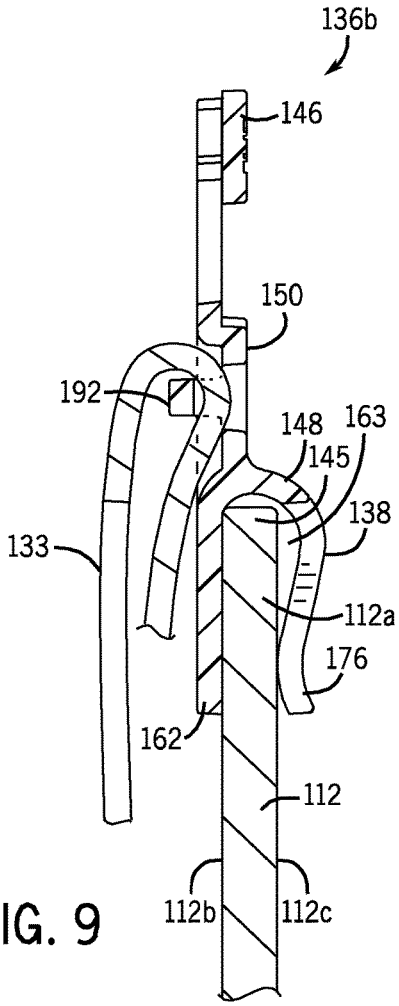
FIG. 9 is a schematic illustration of a buckle component shown in FIG. 4 of a luggage case shown in FIG. 1 with the buckle component attached to a side wall of the luggage case.

FIG. 9 is a schematic illustration of the connectors 136*a*, 136*b* clipped onto the peripheral edge or rim 145 of the lid or base sections 116,118 of the luggage case 100. This is a simpler arrangement than the arrangement described above and shown in FIG. 8 but may prevent the case 100 from being closed when the connector assembly 136 is stowed and fitted to the wall 106,108,110,112 of the case 100. As shown in FIG. 9, the wall engagement feature 148 of the connector 136*b* may be clamped or clipped onto an upper portion 112*a* of the top wall 112 substantially in-line with the top wall 112, with the connector engagement feature 146, the retaining member engagement feature 150, and a portion of the wall engagement feature 148 positioned above the peripheral rim 145 of the top wall 112. The peripheral rim 145 may be positioned within the inner space 163, and the wall 112 may be compressed between the base plate 162 and the clip or hook 138. The base plate 162 may be congruent with an inner surface 112*a* of the top wall 112, and the clip or hook 138 may abut an outer surface 112*b* of the top wall 112.

As should be understood with reference to FIGS. 8-9, the connectors 136*a*, 136*b* may be attached to any of the walls 106,108,110,112 of the luggage case 100. Further, as should be understood by one of ordinary skill in the art, FIGS. 8-9 depict a simplified cross section of the top wall 112, which may include additional features. For example, the top wall 112 may contain many layers, such as a structural wall member, fabric (outer and liner), a zipper or other rim feature over which the connectors 136*a*, 136*b* fit.

Figure 10:
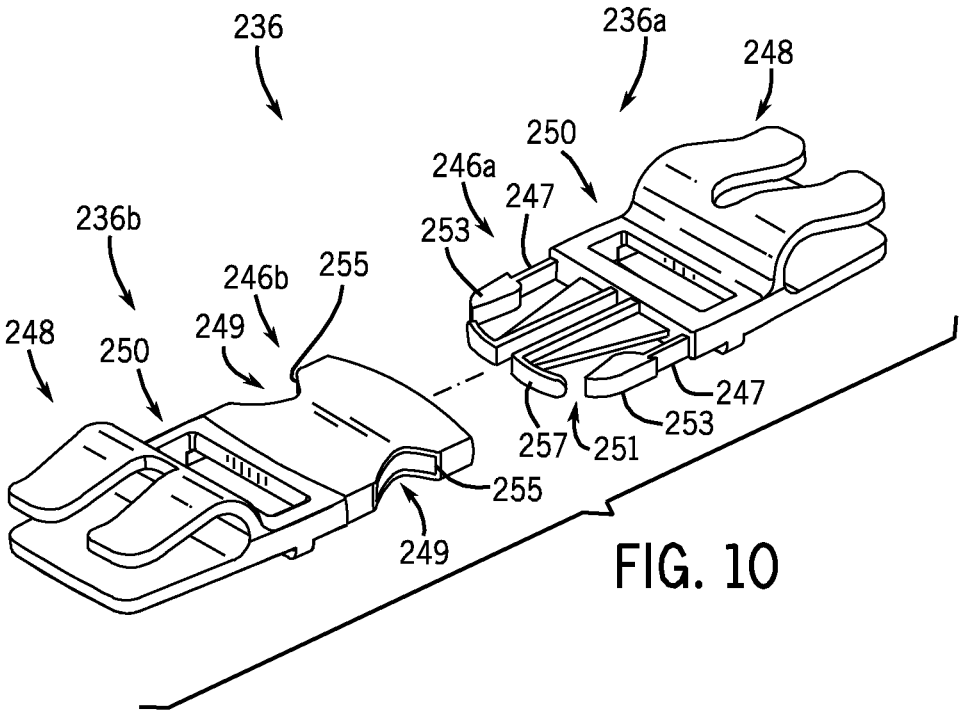
FIG. 10 is a schematic perspective view of a buckle of a luggage case according to another embodiment of the invention.
Figure 11:
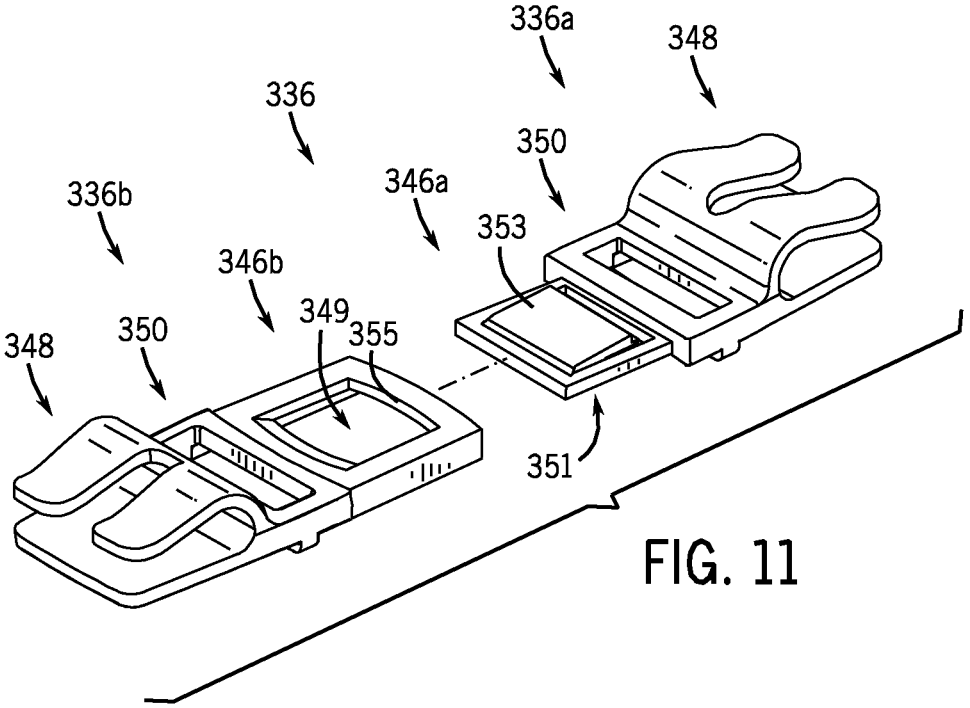
FIG. 11 is a schematic perspective view of a buckle of a luggage case according to another embodiment of the invention.

Although FIGS. 3A-9 illustrate one type of connector engagement feature 146 that may be used, the connectors 136*a*,136*b* may include other connection features to attach the connectors 136*a*,136*b* together. FIGS. 10 and 11 show connector assemblies 236,336, which are generally similar to the connector assembly 136. For example, the connector assemblies 236,336 each include two separable connectors 236*a*,236*b*,336*a*,336*b*, each of which includes a connector engagement feature 246,346, a wall engagement feature 248,348, and a retaining member engagement feature 250, 350 positioned between the connector and wall engagement features 246,248,346,348. The wall and retaining member engagement features 248,250,348,350 are generally identical to the wall and retaining member engagement features 148,150. However, the connector engagement features 246, 346 differ from the connector engagement feature 146.

In FIGS. 10 and 11, the connector engagement features 246,346 each include a push button mechanism 251,351 that connects and disconnects the connectors. In FIG. 10, the male connector 236*a* includes a connector engagement feature 246*a* having a pair of longitudinally-extending, laterally-spaced-apart arms 247. The push buttons 253 snap into opposing receptacles 249 formed in a connector engagement feature 246*b* of a female connector 236*b* to axially secure the male and female connectors 236*a*, 236*b* together. To separate the connectors 236*a*, 236*b*, the push buttons 253 are pushed inwardly until the push buttons 253 clear opposing retaining shoulders 255 formed in the female connector 236*b*. A guide member 257 is positioned laterally between the arms 247 to laterally align the male connector 236*a* with the female connector 236*b* during union of the connectors 236*a*, 236*b*. In FIG. 11, a male connector 336*a* includes a connector engagement feature 346*a* having a cantilevered push button 353 that snaps into a receiving receptacle 349 associated with a corresponding connector engagement feature 346*b* of a female connector 336*b* to secure the male and female connectors 236*a*, 236*b* together. To separate the connectors 236*a*, 236*b*, the push button 353 is depressed inwardly until the push button 353 clears a retaining shoulder 355 formed in the female connector 336*b*.

Figure 12:
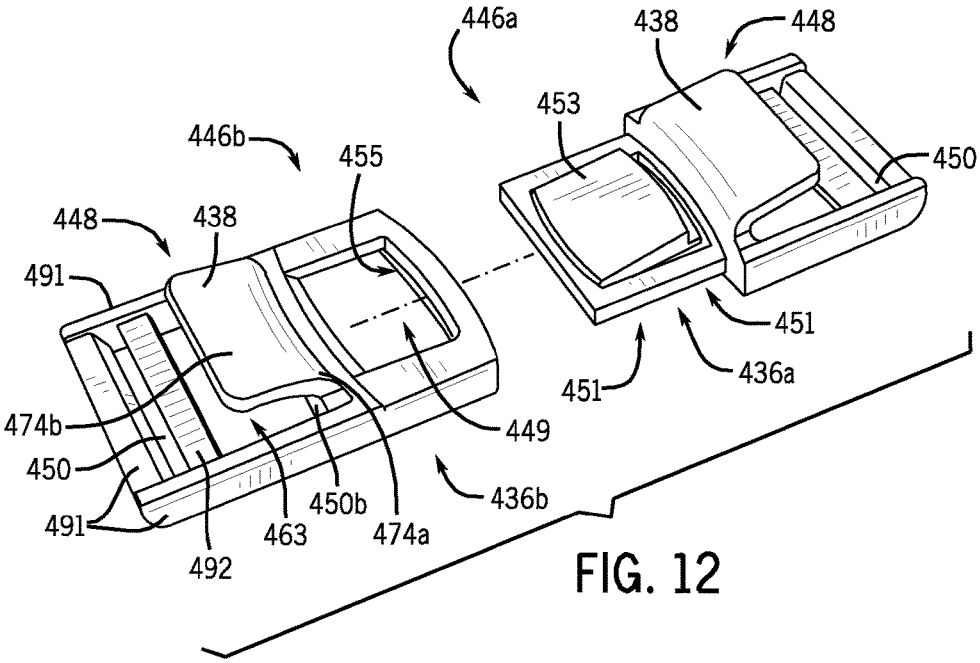
FIG. 12 is a schematic perspective view of a buckle of a luggage case according to another embodiment of the invention.

Referring to FIG. 12, a connector assembly 436 is shown which is generally similar to the connector assembly 136. For example, the connector assembly 436 includes two separable connectors 436*a*,436*b*, each of which includes a connector engagement feature 446, a wall engagement feature 448 and a retaining member engagement feature 450. The wall engagement feature 448 is positioned between the connector and retaining member engagement features 446, 450.

In FIG. 12, the wall engagement feature 448 of the connectors 436*a*, 436*b* may be positioned axially between the connector engagement feature 446 and the retaining member engagement feature 450. The retaining member engagement feature 450 may be configured to attach the connectors 436*a*, 436*b* to the retaining member 132, such as the strap 133 (see FIGS. 3A and 8). The retaining member engagement feature 450 may define a peripherally-bounded aperture 491 and include a transversely-extending rail 492 spanning from one lateral side of the aperture 491 to an opposing lateral side of the aperture 491. To connect the connectors 436*a*,436*b* to the strap 133, a leading end of the strap 133 is routed into the aperture 491 adjacent one transversely-extending face of the rail 492, over the rail 492, and out of the aperture 491 adjacent an opposing transversely-extending face of the rail 492. In this way, the strap 133 is at least partially wrapped around the rail 492 to secure the connectors 436*a*, 436*b* to the straps 133. Similarly, in configurations having a gusset or panel 134, a loop of material 135 may be wrapped around the rail 492 to secure the connectors 436*a*, 436*b* to the panels 134 (see FIGS. 3A and 3B).

In FIG. 12, the connector engagement feature 446 includes a push button mechanism 451 that connects and disconnects the connectors. Similar to FIG. 11, a male connector 436*a* includes a connector engagement feature 446*a* having a cantilevered push button 453 that snaps into a receiving receptacle 449 associated with a corresponding connector engagement feature 446*b* of a female connector

436*b* to secure the male and female connectors 436*a*, 436*b* together. To separate the connectors 436*a*, 436*b*, the push button 453 is depressed inwardly until the push button 453 clears a retaining shoulder 455 formed in the female connector 436*b*.

Figure 13A:
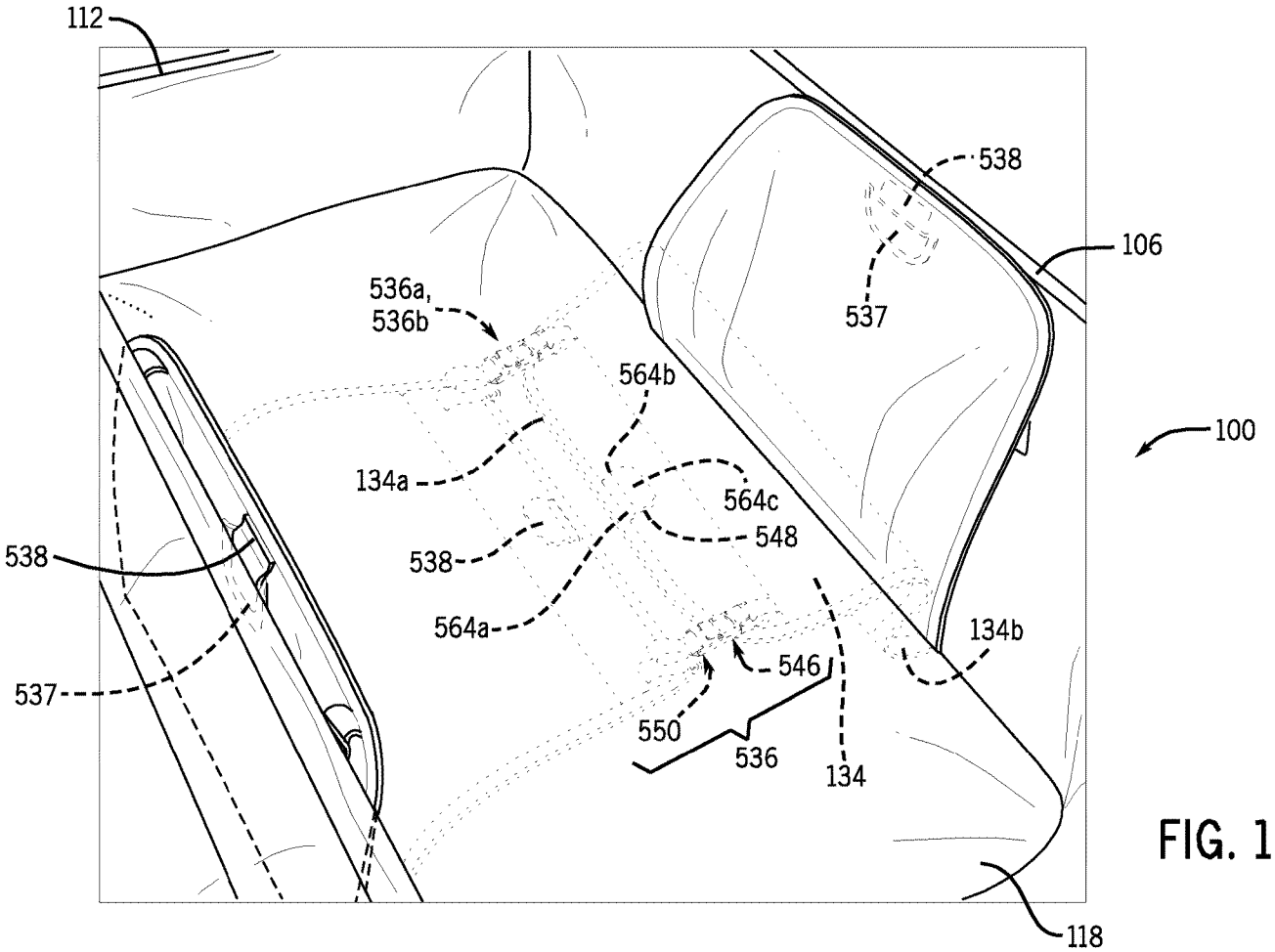
FIG. 13A is a schematic front perspective view of a luggage case shown in FIG. 1 in an open position with example connector assembly attached to opposing side walls according to another embodiment of the invention.
Figure 13B:
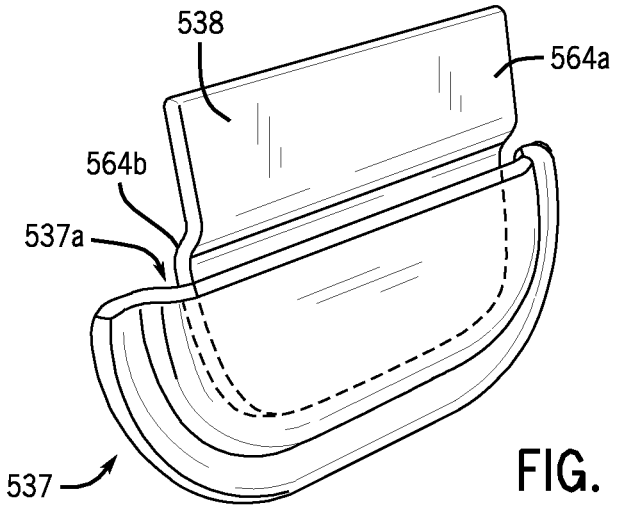
FIG. 13B is a schematic front perspective view of a wall engagement feature shown in FIG. 13A.
Figure 13C:
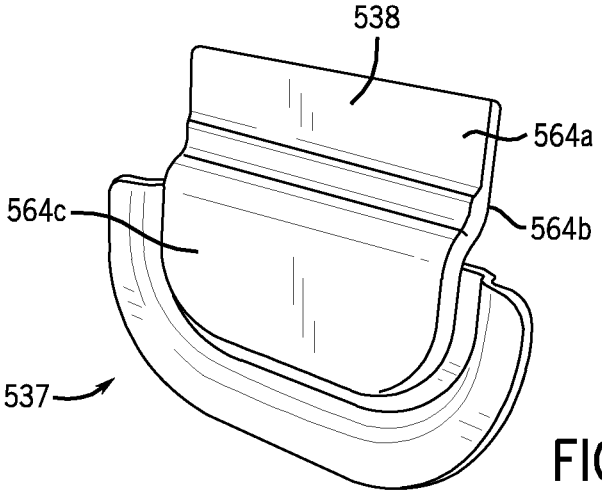
FIG. 13C is a schematic back perspective view of a wall engagement feature shown in FIG. 13A.

The wall engagement feature 448 of the connectors 436*a*, 436*b* is configured to attach the connectors 436*a*, 436*b* to a wall 106,108,110,112 of case 100. The wall engagement feature 448 may be integrally connected to and extend longitudinally away from an end 450*b* of the retaining member engagement feature 450 relative to the connector engagement feature 446. The wall engagement feature 448 may include the clip or hook 438 spatially separated from the rails defining the aperture 491 to define a receiving space 463 between the clip or hook 438 and the aperture 491. The clip or hook 438 may include a first end 474*a* that is integrally connected to one end 450*b* of the retaining member engagement feature 450 and a second end 474*b* that defines a terminal end of the hook or clip 438. Referring to FIGS. 13A-13C, a connector assembly 536 is shown which is generally similar to the connector assembly 136. For example, the connector assembly 536 includes a wall engagement feature 548 and two separable connectors 536*a*, 536*b*, each of which includes a connector engagement feature 546, and a retaining member engagement feature 550. The connector engagement feature 546 and retaining member engagement feature 550 may be similar to those described in FIG. 10. The wall engagement feature 548 is positioned between the connector assemblies 536 on a panel 134. As explained above with reference to FIGS. 3A and 3B, and as shown in FIG. 13A, the panels 134 may be attached at only one end 134*b* to the base section 118 of the case 100. In other configurations, the panels 134 may be associated with the lid section 116 and/or the base section 118 of the case 100.

The panels 134 and/or walls 106,108,110,112 may include a clip or hook 538, and the other of the panels 134 and/or walls 106,108,110,112 may include a corresponding engagement feature, such as a pocket or connecting clip 537 or a defined recess, that cooperates with and receives the clip or hook 538 to attach the panel 134 and first and second connectors 536*a*, 536*b* to one or more of the respective walls 106,108,110,112. The clip or hook 538 of the wall engagement feature 548 may be sewn, adhered, or otherwise attached to the panel 134 and is adapted to attach the first connector 536*a* and/or second connector 536*b* to a respective wall 106, 108, 110, 112. The clip or hook 538 may have an arcuate or curved profile.

Turning now to FIGS. 13B and 13C, and with reference to FIG. 13A, the clip 538 may include a first generally planar segment 564*a* that is attached to a distal end 134*a* of the panel 134 and extends inwardly away from the distal end 134*a* of the panel 134, a second arcuately shaped segment 564*b* that is integrally formed with a unattached end of the first segment 564*a* and extends inwardly toward a wall 106,108,110,112, and a third generally planar segment 564*c* that is integrally formed with a upper end of the second arcuately shaped segment 564*b* and flares outwardly away from panel 134.

As shown in FIGS. 13B and 13C, and with reference to FIG. 13A, the connecting clip 537 is adapted to receive the clip or hook 538 to attach the retaining member 132 and/or the first and second connectors 536*a*, 536*b* to one or more of the respective walls 106,108,110,112. The connecting clip 537 is sewn, adhered, or otherwise attached to a portion, such as an upper portion, of the wall 106. The connecting clip 537 forms a pocket 537*a* adapted to receive and secure the clip or hook 538 and, in some examples, at least the third generally planar segment 564*c* of the clip 538. The clip or hook 538 is secured in the pocket 537*a* by a friction fit or other suitable separable means, such as a magnet, that permit connection and disconnection of the clip 538 and connecting clip 537.

When the first and second connectors 536*a*, 536*b* are releasably connected together, the retaining members 132 are extended over one's belongings across the enclosed space 115 of the case 100 to secure the belongings in the respective lid or base section 116,118. In this connected configuration, the location of the connector assembly 536 relative to the walls 106,108,110,112 of the case 100 may vary based on the amount of belongings packed in the respective lid or base section 116,118, the shape of the belongings, and any other factor. The connector assembly 536 and associated retaining member 132 may be referred to as a content securing member.

With continued reference to FIG. 13A, the respective first and second connectors 536*a*,536*b* are disconnected from one another and attached to opposing walls 106,108,110,112 of the luggage case 100, such as via the connecting clip 537 and clip 538, to positively locate the buckle components 536*a*,536*b* and associated retaining members 132 near a periphery of the side walls 106,108 of the respective lid and base sections 116,118 of the case 100, thereby allowing the user to easily find the connectors 536*a*,536*b* during and after packing.

Generally, the connector assembly includes a first connector and a second connector, which may be repeatedly connected and disconnected from one another during use. Each connector includes or is associated with a wall engagement feature that allows the respective connector to be attached to the opposing walls of the luggage case, generally out of the way of a user during packing. This enables a user to easily access the connectors during and after packing, without digging through the packed belongings to find the connectors or retaining members. After the belongings are packed in the luggage case, the user may detach the connectors and/or wall engagement features from the walls of the case and join the connectors together to secure the packed belongings within the case. The connectors may include various types of connector engagement features that interact with one another to join the connectors together. The connectors may be associated with various types of wall engagement features, such as a clip or hook, a cord, or other suitable features, that facilitate attachment of the connectors to the walls of the case 100. The connectors may be attached to any wall of the luggage case. The connector assembly may be referred to as a buckle assembly, and the first and second connectors may be referred to as first and second buckle components.

While these embodiments have been described in relation to a hard side suitcase, other embodiments may include a soft side case, a hybrid side case, or various types of bags. The clip may be located on either side of the buckle component. The retaining members may be cords, cables, lines, straps, or other types of material. The retaining members may be continuously flexible, such as a fabric, or discretely flexible, such as a chain- or link-like structure.

The apparatuses and associated methods in accordance with the present disclosure have been described with reference to particular embodiments thereof in order to illustrate the principles of operation. The above description is thus by way of illustration and not by way of limitation. In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

What is claimed is:

1. A luggage article comprising:

a plurality of walls together defining an outer structure and an enclosed space of the luggage article;

a first flexible retaining member attached to and extending from one of the walls; and a connector assembly including a first connector and a second connector that releasably connect together, the first connector attached to the first flexible retaining member at a position spaced from the attachment of the first flexible retaining member to the respective one of the walls, the second connector attached to one of the walls in opposing relationship to the first connector, when the first and second connectors are releasably connected together, the first flexible retaining member is extended across at least a portion of the enclosed space;

wherein the first connector includes a connector engagement feature and a wall engagement feature, and the first connector and/or a respective wall are adapted to attach the first connector to the respective wall via the wall engagement feature.

2. A luggage article as claimed in claim 1 wherein the first connector and/or respective wall includes a clip or hook.

3. A luggage article as claimed in claim 1 wherein the connector assembly and/or respective wall includes a clip or hook.

4. A luggage article as claimed in claim 3 wherein the clip or hook is positioned at a distal end of the first flexible retaining member.

5. A luggage article as claimed in claim 2 wherein the clip or hook comprises an integral part of the first connector.

6. A luggage article as claimed in claim 3 wherein the clip or hook is attached to the first flexible retaining member.

7. A luggage article as claimed in claim 3 wherein the first connector is indirectly attached to the respective wall.

8. A luggage article as claimed in claim 2 wherein the clip or hook includes two resilient fingers having laterally-offset free ends.

9. A luggage article as claimed in claim 2 wherein the clip or hook is adapted to fit over a peripheral edge of the respective wall of the luggage article when the luggage article is open.

10. A luggage article as claimed in claim 1 wherein the first and second connectors include corresponding connector engagement features that releasably connect the first and second connectors together.

11. A luggage article as claimed in claim 10 wherein the first retaining member is attached to the first connector between a respective connector engagement feature and a clip or hook.

12. A luggage article as claimed in claim 1 wherein the first connector and/or respective wall includes a cord that cooperates with a clip or hook to attach the first connector to the respective wall.

13. A luggage article as claimed in claim 1 wherein the first retaining member comprises a strap.

14. A luggage article as claimed in claim 13 wherein the strap is attached at opposite ends to the respective one of the walls, and the first connector is attached to a mid-portion of the strap.

15. A luggage article as claimed in claim 1 wherein the first retaining member comprises a flexible panel.

16. A luggage article as claimed in claim 1 wherein the connector assembly includes a push button release mechanism to release the first and second connectors.

17. A luggage article as claimed in claim 1 wherein the connector assembly comprise a buckle assembly and the first and second connectors comprise first and second buckle components.

18. A luggage article as claimed in claim 1 wherein the first and second connectors releasably snap fit together axially and/or rotationally.

19. A luggage article as claimed in claim 1 further comprising a second flexible retaining member attached to and extending from one of the walls, wherein the second connector is attached to the second retaining member at a position spaced from the attachment of the second retaining member to the one of the walls.

20. A luggage article as claimed in claim 1 wherein the second connector and/or a respective wall are adapted to attach the second connector to the respective wall.

21. A luggage article comprising:

a plurality of walls together defining an outer structure and an enclosed space of the luggage article;

a flexible retaining member attached to and extending from one of the plurality of walls; and a connector assembly including first and second connectors that releasably connect together to selectively extend the flexible retaining member across at least a portion of the enclosed space;

wherein:

the first connector includes a connector engagement feature and a wall engagement feature each attached to the flexible retaining member at a position spaced away from the attachment of the flexible retaining member to the one of the plurality of walls, the connector engagement feature adapted to releasably connect to the second connector, the wall engagement feature adapted to engage a wall of the plurality of walls; and the second connector is attached to the flexible retaining member at a position spaced away from the attachment of the flexible retaining member to the one of the plurality of walls.

22. The luggage article of claim 21, wherein the connector engagement feature and the wall engagement feature of the first connector are integrally formed together as a single unit.

* * * * *